United States Patent [19]

Juslin et al.

[11] Patent Number: 4,879,928

[45] Date of Patent: Nov. 14, 1989

[54] BALLOON STRETCHER

[76] Inventors: Scott E. Juslin; Lee Juslin, both of Box 454, Rte. 4, Northwood, N.H. 03261

[21] Appl. No.: 229,537

[22] Filed: Aug. 8, 1988

[51] Int. Cl.[4] ..... B25B 9/00

[52] U.S. Cl. ..... 81/488; 81/485; 269/48.1

[58] Field of Search ..... 81/485, 488; 29/235, 29/239; 269/48.1; 128/303.11, 303 A, 345

[56] References Cited

U.S. PATENT DOCUMENTS

| | | | |
|---|---|---|---|
| 3,386,371 | 6/1968 | Farmer et al. | 29/235 |
| 3,835,522 | 9/1974 | Ward | 29/239 |
| 4,706,358 | 11/1987 | Johnson et al. | 29/235 |

FOREIGN PATENT DOCUMENTS

| | | | |
|---|---|---|---|
| 237824 | 1/1962 | Australia | 29/235 |

*Primary Examiner*—Roscoe V. Parker

[57] ABSTRACT

The Balloon Stretcher includes a molded base and a bottom bolt which adjusts to clamp the base to a countertop. Within the base and projecting from it is a stationary rod and an adjustable rod with a handle. This adjustable rod has a set screw which, when loosened allows the rod to be pulled out and away from the fixed rod and, when tightened, allows the adjustable rod to be held firmly in any one of various positions. By loosening the set screw the adjustable rod may be pushed back to its starting position, parallel to the stationary rod. The neck of a latex balloon in any size from five inches and larger is fitted over and up the ends of both rods. The rods are inside the balloon and the rod ends protrude into the body of the balloon. The set screw is then loosened and the adjustable rod is pulled out in a straight line away from the Balloon Stretcher base. The neck of the balloon is thus stretched open and, with the set screw tightened, objects may be inserted into the neck of the stretched balloon between the rods and pushed down into the balloon just below the balloon neck opening. The set screw is then loosened and the adjustable rod is pushed back into its start position. The balloon with the object inside is then pulled off both rods simultaneously and is ready to be inflated.

5 Claims, 1 Drawing Sheet

BALLOON STRETCHER

BACKGROUND

This invention relates to latex balloons from the five inch size and larger.

Currently the way to insert objects into a balloon including, but not limited to, teddy bears, silk flowers, and small gift items, involves two people. Person #1 stretches the balloon open by inserting a finger from each hand or two blunt ended objects such as pencils into the neck of the balloon side by side. Person #1 then pulls his fingers or the pencils in opposite directions thus stretching open the balloon's neck. Person #2 then pushes the object to be inserted down through the balloon's neck between the two fingers or pencils. Person #1 then moves his two fingers or pencils back toward their starting position and, with help from person #2, eases them up and out of the balloon neck without disturbing the inserted object.

This old-fashioned, manual method is both awkward and inefficient. Stretching a balloon manually requires muscle strength and, also, causes muscle strain to the person doing the stretching. Because of the strength involved and the strain most people have difficulty stretching a balloon neck to its maximum size and can only hold it in a stretched position for a very limited time. Also, frequent rest periods are required. In addition, because the manual method requires two people, it means that a small business with only one clerk can not offer customers balloons with objects inside. Similarly, larger shops with two or more clerks will find the Balloon Stetcher a labor-saving device since, with only one clerk needed, it is not necessary to pull another worker away from other tasks.

SUMMARY

The Balloon Stretcher allows one person alone to insert objects into balloons. It also allows a balloon to be stretched to its maximum and held in position indefinitely. This means the size capacity for each balloon from 5" and up is greater than with the old manual method. Also, using the Balloon Stretcher is quicker and more efficient. There is also less chance of damage to a balloon or the object going inside since there are no sharp edges or points. Using the Balloon Stretcher allows a person to work at his own speed and provides optimum access to the balloon openning, because there is no second human body in the way and the person can work from either or both sides of the stretched balloon. The Balloon Stretcher makes a difficult process much easier and, thus, will allow people in areas related to balloon artistry, such as florists, to offer fancier balloon arrangements to their customers.

Figure 1:
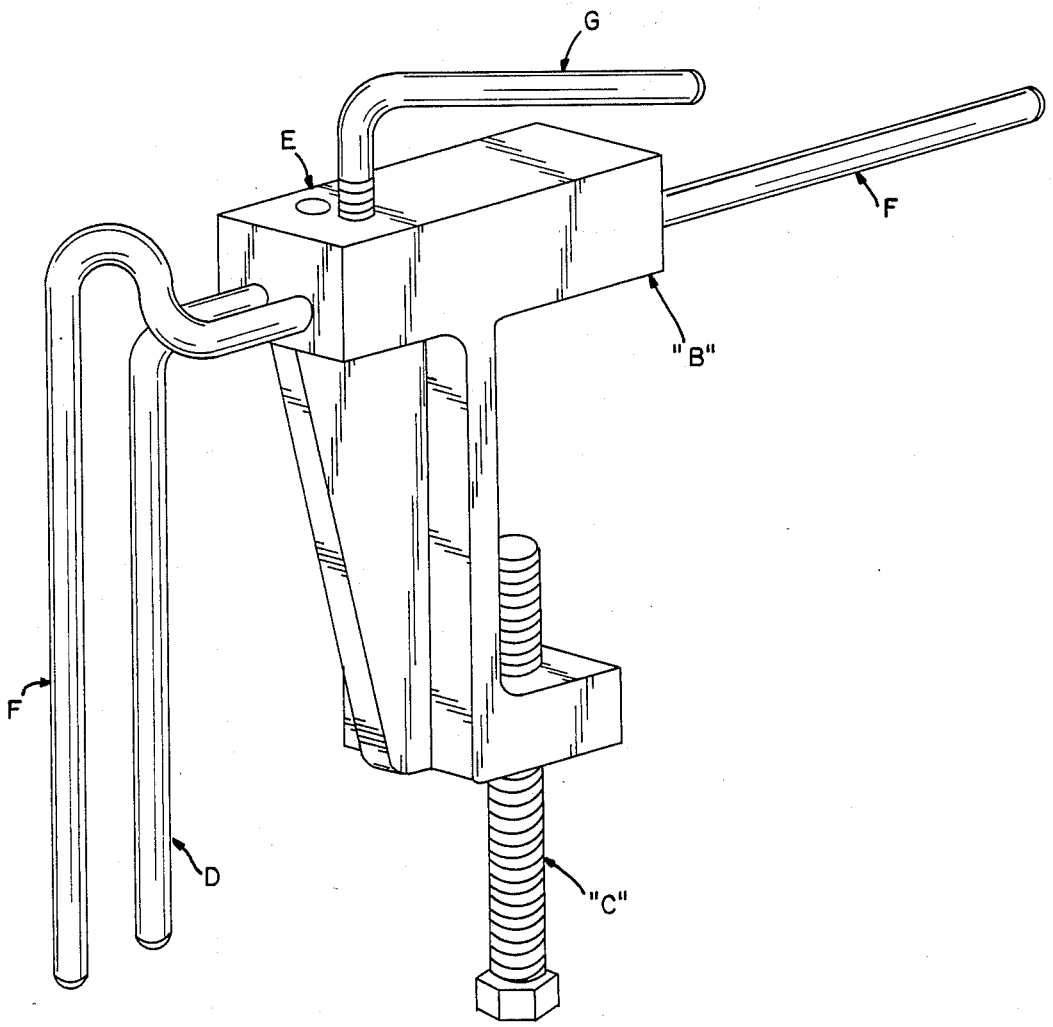
FIG. 1 is a perspective view of the Balloon Stretcher showing the following parts.

B—molded base;
C—base clamping bolt;
D—stationary rod;
E—stationary rod screw;
F—adjustable rod with handle or finger loop;
G—set screw handle.

DESCRIPTION OF THE EMBODIMENT

In order to understand the principles of the invention, reference will now be made to the embodiment illustrated in the drawing and specific language will be used to describe the same. It will nevertheless be understood that no limitation of the scope of the invention is intended, such alterations and further modifications in the illustrated device and such further applications of the principles of the invention as illustrated therein being contemplated as would normally occur to one skilled in the art to which the invention relates.

Referring to FIG. 1, there is illustrated a device having a molded base B. This molded base has attached to its underside a base clamping bolt C. The purpose of the base clamping bolt C which is adjustable is to allow the device to be firmly clamped to a countertop, shelf, or similar. The molded base B has within it and protruding from it, a stationary rod D made stationary by means of a stationary screw E. Similarly there is an adjustable rod F with a finger loop that is made adjustable by working the set screw handle G.

A latex balloon is fitted simultaneously up and onto the tips and lower portions of the stationary rod D and the adjustable rod F. When the set screw handle G is moved to the open position the adjustable rod F is pulled out and away from the molded base B as well as the stationary rod D by hooking an index finger through the finger loop on the adjustable rod F and pulling, thus stretching open the neck and body of the attached latex balloon. The set screw handle G is then tightened to hold the balloon in its stretched position. While one hand of the operator holds the balloon neck open by pulling a top edge outward from between rods D,F, the object selected for insertion is now pushed into the balloon down through the neck openning between the stationary rod D and the adjustable rod F. Once the object is inside the balloon, the set screw handle G is loosened and with index finger and thumb on the finger loop of the adjustable rod F the adjustable rod F is pushed back towards the molded base B and its start position. The adjustable rod F will not return completely to its start position next to the stationary rod D because of the object now within the balloon. However, the adjustable rod F will return close enough to its start position to release the tension caused by the extended stretch position, thus allowing the operator to pull the balloon down and off both rods D,F.

While the invention has been illustrated and described in detail in the drawing and foregoing description, the same is to be considered as illustrative and not restrictive because only the preferred embodiment has been shown and described, but it is the inventors' desire to protect any and all changes or modifications that come within the spirit of the invention.

We claim:

1. A device designed to be used with latex balloons five inches and larger consisting of a molded base, and adjustable bottom bolt, cooperating with said base for clamping the device to a countertop, said base having one stationary rod and one adjustable rod with said adjustable rod being controlled by a set screw and a finger loop.

2. The device in claim one wherein when the two rods are next to each other in the start position and the set screw is tight the neck of a latex balloon can be put onto and over the ends of the two rods causing the rod tips to extend down into the balloon.

3. The device of claim 2 wherein the set screw controlling the adjustable rod can be loosened and the adjustable rod pulled forward stretching open the neck of the balloon.

4. The device of claim 3 wherein when the set screw is tightened the balloon will be held in the stretched position indefinitely allowing an object to be pushed into the balloon between the two rods.

5. The device of claim 4 wherein when the set screw is loosened the adjustable rod can be pushed back towards its start position allowing the balloon to be pulled down and removed from the device along with the object inside.

* * * * *